US005243767A

United States Patent [19]

Stein

[11] Patent Number: 5,243,767

[45] Date of Patent: Sep. 14, 1993

[54] METHOD AND APPARATUS FOR PROCESSING PARTICULATE MATERIAL

[76] Inventor: Peter Stein, c/o Granaria S.A., P.O. Box (AP. Postal) 64698, Caracas 1064A, Venezuela

[21] Appl. No.: 922,998

[22] Filed: Jul. 30, 1992

[51] Int. Cl.[5] ..... F26B 17/00

[52] U.S. Cl. ..... 34/10; 34/57 A

[58] Field of Search ..... 34/57 A, 10, 57 R, 168, 34/171, 174

[56] References Cited

U.S. PATENT DOCUMENTS

| | | | |
|---|---|---|---|
| 1,783,965 | 12/1930 | Jackson . | |
| 2,299,299 | 10/1942 | Bills . | |
| 2,458,356 | 1/1949 | Evans . | |
| 2,532,335 | 12/1950 | Royster . | |
| 2,581,134 | 1/1952 | Odell . | |
| 2,676,668 | 4/1954 | Lindsay . | |
| 2,777,760 | 1/1957 | Dineen et al. . | |
| 2,893,849 | 7/1959 | Krebs . | |
| 3,052,990 | 9/1962 | Tailor | 34/57 A |
| 3,263,346 | 8/1966 | Vandenhoeck | 34/57 A X |
| 3,511,843 | 5/1970 | Lewis . | |
| 3,559,299 | 2/1971 | Tyler . | |
| 3,648,753 | 3/1978 | Bergquist . | |
| 4,021,927 | 5/1977 | Idaszak . | |
| 4,030,205 | 6/1977 | Robertson et al. . | |
| 4,800,653 | 1/1989 | Steffen . | |
| 5,158,754 | 10/1992 | Lefers et al. | 34/57 A X |

FOREIGN PATENT DOCUMENTS

| | | | |
|---|---|---|---|
| 392307 | 7/1983 | U.S.S.R. | 34/10 |
| 1109197 | 4/1968 | United Kingdom | 34/10 |
| 1190287 | 4/1970 | United Kingdom | 34/10 |

*Primary Examiner*—Henry A. Bennet
*Attorney, Agent, or Firm*—Cooper & Dunham

[57] ABSTRACT

The present invention relates to a method and apparatus for drying particulate materials such as seeds and grains in which an air dryer having a shape of a vertical, cylinder and at least one drying stage with a mesh screen disposed therein with a horizontal mesh screen. An upwardly vertical air flow having a velocity in the mesh openings at least equal or larger than to the suspension speed of the particles to be dried temporarily suspends the particles until enough accumulate to provide sufficient weight or downward pressure for the particles to overcome the upward air flow, pass downward through one or more mesh screens and reach the bottom of the dryer.

26 Claims, 2 Drawing Sheets

METHOD AND APPARATUS FOR PROCESSING PARTICULATE MATERIAL

BACKGROUND OF THE INVENTION

The present invention relates to a method and apparatus for drying materials, particularly seeds and grains, by introducing the material at the top of an upwardly vertical air flow arrangement.

In certain industries there is a need to dry large amounts of particle formed materials such as seeds and grains. In the past, various methods including belt conveyor and rotary drum dryers have been used which require relatively high investment in equipment and space. Moreover, in most systems, the seeds may get damaged in the drying process, and the drying process may require much time.

It is therefore an object of the present invention to provide an improved method and apparatus for drying of particle formed materials such as seeds and grains, the improvement being in terms of initial investment and drying time.

SUMMARY OF THE INVENTION

For the purpose of attaining the object mentioned above, the present invention provides an apparatus for drying particle formed materials such as seeds and grains, comprising a housing having a top, bottom and side walls, means for introducing materials to be dried into the housing, at least one drying stage having mesh means defining openings greater than the largest size particle of the material to be dried, the drying stage located between the top and bottom walls and extending to the side walls of the housing, air flow means for creating an upwardly vertical flow of air within the housing having a velocity within the mesh openings at least equal to the speed at which the material to be dried remains suspended, whereby material to be dried will remain suspended until enough particles accumulate above the mesh means to provide sufficient weight or downward pressure for the particles to overcome the upward air flow, pass through the openings in the mesh means and fall downwardly toward the bottom of the housing.

According to another aspect of the invention, there is provided an air dryer wherein the air flow means comprises an air inlet means at the bottom of the housing and an air outlet means at the top of the housing.

The invention still further provides an air dryer wherein the particle formed materials are seeds or grains and wherein said housing is cylindrical.

According to another aspect of the invention, there is provided an air dryer wherein the distributor comprises a plurality of concentric distribution cones to distribute the materials over a horizontal plane of an uppermost drying stage.

Another aspect of the invention provides an air dryer further comprising supply means for supplying the materials to the interior of the distributor and wherein the supply means is a belt conveyor.

Another aspect of the invention provides an air dryer wherein the mesh means comprises a ring and a wire mesh screen attached to the ring.

The invention still also provides an air dryer further comprising removal means for removing dried materials from the bottom of the housing and for an air dryer wherein the number of the drying stages equals five.

According to another aspect of the invention, there is provided an air dryer wherein the air flow means comprises means for introducing air tangentially to the bottom of the housing and another aspect of the invention provides an air dryer further comprising heating means for heating the air entering the housing.

The invention also provides an air dryer wherein said means for heating the air entering the housing comprises an inner chamber for receiving air to be heated and for providing heated air to the housing and an outer chamber, in thermal communication with the inner chamber, for receiving combustion air, whereby air in the inner chamber is heated through thermal contact with said outer chamber.

According to another aspect of the invention, there is provided an air dryer which further comprises an extraction fan and a damper for controlling the upward rate of flow of air within the housing.

Another aspect of the invention provides an air dryer further comprising a separator after the outlet means for removing relatively small particle material from outlet air and the invention also provides an air dryer further comprising material removal means at the bottom of the housing for removing the dried materials.

The invention also provides an air dryer wherein the housing has a plurality of windows for monitoring drying stages within the housing.

Another aspect of the invention provides an air dryer wherein the outlet means comprises an upper spiral shaped airflow chamber communicating with the chamber top wall by a plurality of openings to the top wall of said housing, and a corresponding plurality of pivotable gates over said openings to control the air flow through the openings.

The invention also provides an air dryer wherein the air flow means further comprises a lower spiral shaped air flow chamber communicating with the chamber bottom wall by a plurality of openings in the bottom wall of said housing, and a corresponding plurality of pivotable gates over the openings to control the air flow through the openings.

The present invention also provides a method for drying particle formed materials such as seeds and grains comprising the steps of loading particle formed materials to be dried into the top of a housing of a dryer having a top, bottom and side walls, and at least one drying stage having a mesh means defining openings greater than the largest size particles to be dried, the mesh means located between the top and bottom walls and extending to the side walls of the housing, and creating an upward air flow in the housing having a velocity in the mesh openings at least equal to the suspension speed of materials to be dried, whereby particles to be dried will remain suspended until enough particles accumulate above the mesh means to provide sufficient weight or downward pressure for the particles to overcome the upward air flow, pass through the openings in the mesh means and fall downwardly toward the bottom of the housing.

The invention also provides a method for drying materials further including the step of heating the air prior to introduction of the air into the housing.

The invention also provides a method for drying materials further including the step of introducing air into the top of the housing above the drying stage.

Another aspect of the invention provides a method for drying materials further including the step of removing the dried materials from the bottom of the housing.

The invention also provides a method for drying materials wherein the materials are seeds or grains.

Advantageously, the invention provides for using an upward air flow for both (1) heating and drying, and (2) regulating the time of exposure and the transport of particles through the drying stages. The invention thus avoids the need for a separate conveyor means, such as a conveyor belt or rotary drum.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF THE PREFERRED EMBODIMENT

Figure 2:
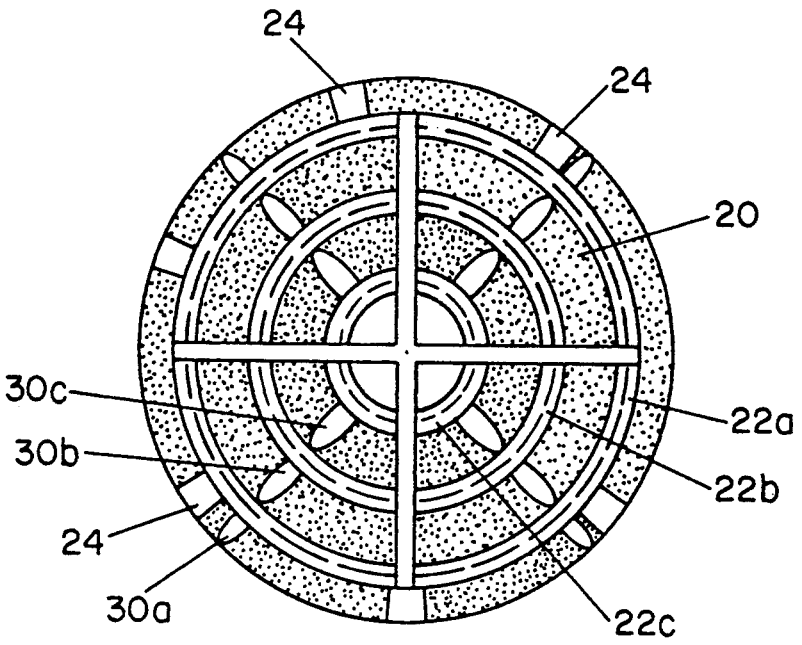
FIG. 2 is a top view of a drying stage of the present invention.
Figure 3:
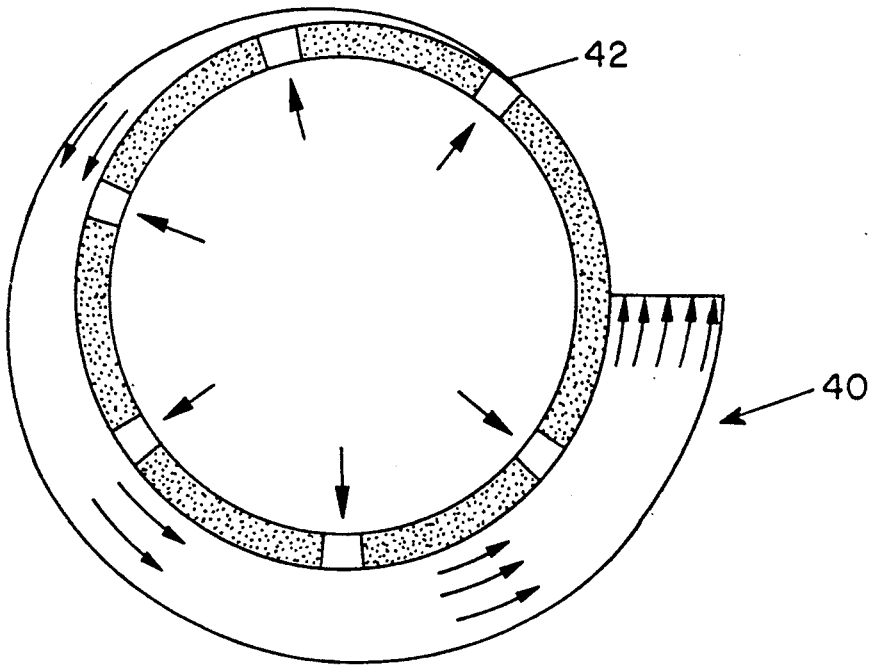
FIG. 3 is a top view of a spiral shaped air flow chamber at the top of the housing.

A preferred embodiment of a dryer 10 according to the invention will be described with reference to FIGS. 1-3, which show a seed or grain dryer having a plurality of drying stages defined by a corresponding plurality of mesh screens. However, the invention is not limited to seed or grain drying, or to the particular embodiment described.

Figure 1:
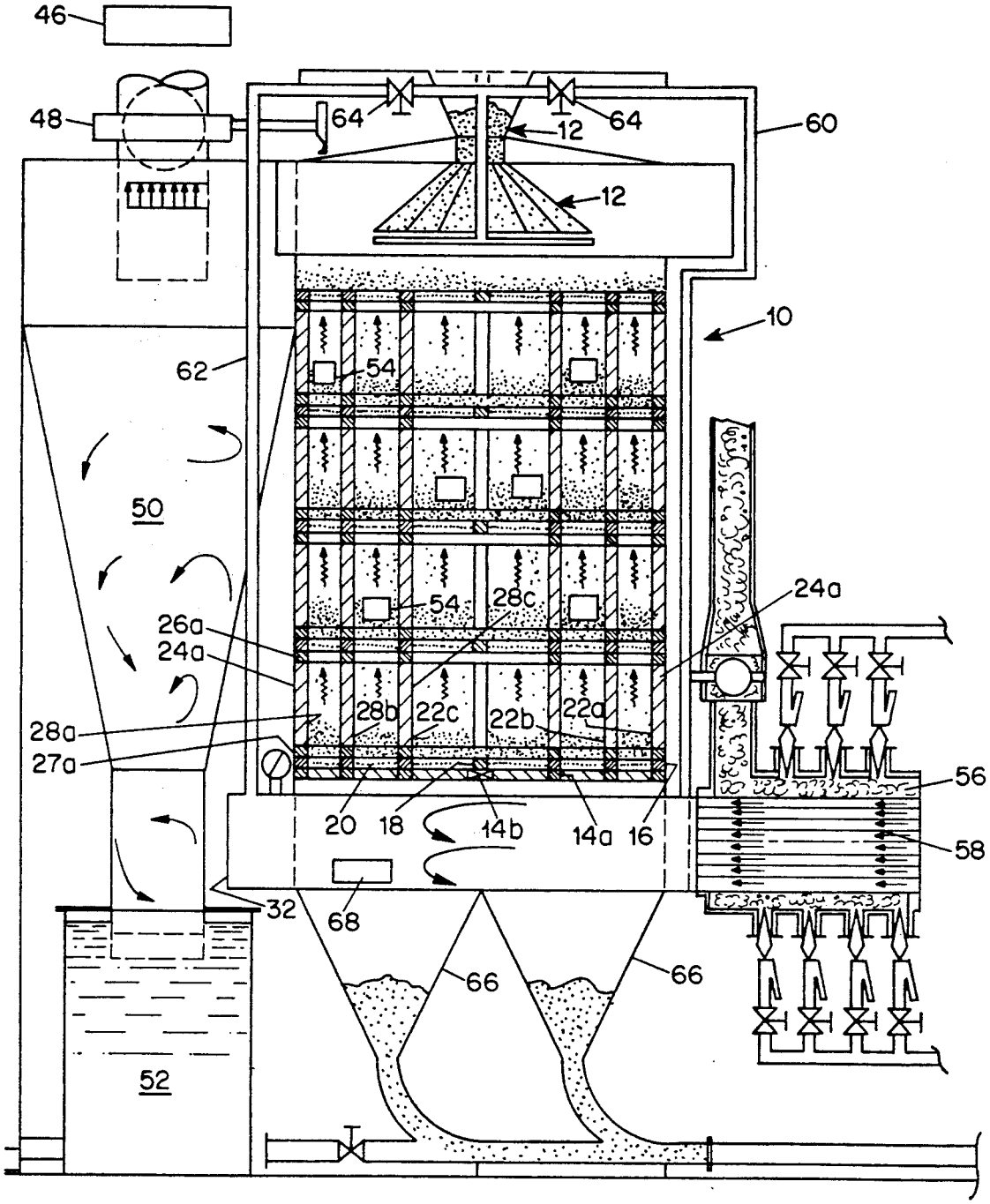
FIG. 1 is an elevational view, in cross-section, of an embodiment of the present invention.

As shown in FIG. 1, wet materials such as seeds to be dried are fed by way of a belt conveyor or other similar transport means into the top of a cylindrical housing by a distributor 12, which uniformly spreads the material over the entire cross-section of the housing by way of concentric distribution cones. The wet materials may be fed into the distributor.

The dryer 10 has a plurality of vertically stacked drying stages, in this case 5 in number. At the base of the chamber are support cross bars 14*a*, 14*b* supporting the whole weight of the various stages, and at their ends the cross bars are welded to the body of the dryer at the side walls. The first drying stage rests on the cross bars 14*a*, 14*b*. The first drying stage comprises a horizontal ring 16 strengthened by welded crossbars 18 on top of which a horizontal mesh 20 is bolted. As shown in FIG. 2, on top of the mesh 20 is a set of three (3) concentric cages 22*a*, 22*b*, 22*c*. Cage 22*a* is arranged by welding vertical bars 24 to a upper ring 26*a* and lower ring 27*a* of same diameter, and by screwing or bolting a cylindrical mesh 28*a* to the inner surface of the cage 22*a*. Cages 22*b* and 22*c* are constructed in the same way. To maintain concentricity of the cages, radial arm spacers 30*a*, 30*b*, 30*c*, extend from each ring and are welded to the top and/or bottom rings. The ends of the radial arm spacers contact the inner surface of the next largest ring, or in the case of the largest ring, contact the inner cylindrical wall of the housing. The cages keep the seeds from migrating to the outer periphery of the drying stages as a consequence of centrifical effect of rotating air. The other drying stages are similarly arranged and are stacked on top of each other. Such an arrangement provides flexibility in the number of drying stages desired, and also provides for easy disassembly of the unit for cleaning and maintenance.

The size of the openings in the mesh screens (sometimes called mesh clearance) should be greater than the largest size of the materials intended to be dried. For example, in the case of sesame seeds, the suggested mesh clearance or distance between adjacent wires is 4.5 or 5 mm (0.18 or 0.2") with the wire being 1-1.5 mm (0.04-0.06") thick. The typical length of sesame seeds is 2-3 mm while their width is 1-2 mm. This allows for even the largest seeds to be able to pass through the mesh screen openings. The mesh openings create a contraction in the cross-section about 50%, which results in about doubling the air speed through the mesh openings relative to the airflow in remaining part of the (horizontal) cross-section of the dryer.

Drying air, preferably heated, is introduced into the dryer housing by means of a lower spiral shaped inlet casing 32 which introduces air tangentially into the housing. As indicated by arrows, the air travels around the spiral shaped chamber which has a decreasing cross-sectional area toward the center. A number of pivotable gates are situated in openings in the interior wall of the inlet casing to allow for the air to pass into the bottom of the housing and to ensure that the air is distributed evenly within the dryer cross-section. These gates are similar to those described below in the upper spiral shaped chamber 40 and shown in FIG. 3. Opening and closing of the gates is controlled by a mechanical device actuated from outside, which allows for fixing the position of the gates, thus allowing to control rotation of the upward air flow.

A similar arrangement of an upper spiral shaped chamber 40 with pivotable gates 42 in respective wall openings is mounted above the uppermost drying stage for controlling the vertical air flow and for allowing for air that has passed through the housing to be removed. The air is evenly removed over the cross sectional area of the housing so that there will be a uniform upwardly vertical air flow within the housing. The air passes into the chamber of the outlet casing through the open gates and travels around the spiral shaped chamber to the exit which has a larger cross sectional area.

A water and trash separating cyclone 50 is connected to the spiral outlet chamber of the dryer and is dimensioned to provide separation of water and trash from the mixture, at only a moderate sacrifice of pressure loss. The trash is collected in collection bin 52. An extraction fan 46 creates a subatmospheric pressure inside the dryer cylindrical housing. The damper 48 at the top exit of the cyclone 50 controls the velocity of the upwardly vertical air flow. The damper 48 can be varied until the air speed at the mesh screen equals or is slightly greater than the suspension speed of the seeds.

The progress of the drying can be monitored from any one of a number of built-in windows 54 in the housing side walls which enable viewing of the distribution of seeds in the various drying stages. If the air speed at the mesh screen equals or is slightly higher than the suspension speed, the seeds will float on top of the mesh but will not pass through until enough seeds accumulate to provide sufficient weight or downward pressure to overcome the force of the upward air flow. Physical contact of the seeds with the hot mesh screens will provide additional heat transfer by conduction in addition to that of the connection created by the upward air flow, which also help speed up the drying of the seeds. When the upward vertical air flow passes the seeds which are then suspended they are caused to rotate by the rotational component of the flow. This rotation of the seeds further delays their passing through the mesh screen openings, thus increasing the effective drying time of the seeds, rotation being controlled by gates as described above.

The air may be heated by gas or gas-oil combustion. In the former case the gas flame as well as the combustion smoke may be fed directly into the mouth of the inlet casing. Heating air in this way is thermally most efficient while still being relatively clean. However, if the materials to be dried must be perfectly clean or substantially pollution-free, indirect heating of the drying air may be accomplished by having an outer combustion chamber 56 which conducts heat by fins 58 into a clean air inlet providing air to the inlet casing 32. In the case of gas oil or fuel oil, an indirect fire and separate removal of the dirtier smokes is usually necessary. The thermal efficiency of the dryer will then also depend on how much combustion heat is lost in the smoke removal. The fuel supply preferably should be sufficient to heat the air up to around 350° C. (660° F.) at the inlet casing 32 so as to ensure that the temperature at outlet casing 40 remains high enough.

Two vertical pipes 60, 62 connecting the inlet casing to the exit of the material distributor cones 12 with valve controls 64, allow for dry hot air to be introduced at the top of the housing into the top drying stage in order to improve the drying effect at this stage.

When the materials have filtered through the mesh screens of the successive drying stages and have reached the bottom of the housing they are ready to be removed. The dry materials can be collected in one or more bottom cone or hoppers 66. A large window 68 is preferably provided to allow for good visibility and access to the collected materials. Removal of the seeds can also be accomplished by vacuum suction. When it is desirable to use a dryer that has a housing with a large diameter, the height of the dryer can be minimized by having a plurality, in this case four hoppers 66, two of which are shown in FIG. 1. The recommended mesh screen diameter and appropriate suspension speed for the seeds to be dried may be estimated and will be dependent upon the specific weight, size and shape of seed. Laboratory results are of course preferable to ensure the best accuracy. One advantage of this type of dryer is its simplicity, resulting in low costs of construction and of maintenance.

The air dryer does not require accessory equipment like the motor driven belt conveyors (conveyor dryer) or the large motor driven rotary drums (rotary dryer), as have been used in previous dryers and therefore reduces the effective costs of maintenance. The volume of the drying stages (effective drying zone) needed for a given seed or grain size and amount is probably smaller in this dryer than in any other dryer. The relatively small drying volume needed for an amount of materials will reduce the weight and cost of construction materials.

Keeping the seeds in suspension in a highly turbulent and hot air bed is a most effective drying method. Also the formation of layers of wet seeds which would lengthen effective drying time is unlikely. This air dryer also acts as an effective cleaning machine which removes or aspirates impure particles which are lighter than the seeds by these particles being entrained in the upward air flow which exits at the top of the dryer.

It will be evident to those skilled in the art that the invention is not limited to the details of the foregoing illustrated embodiment and that the present invention may be embodied in other specific forms without departing from the spirit or essential attributes thereof. The present embodiment is therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed is:

1. An air dryer for drying particle formed materials comprising:

a housing having a top, bottom and substantially parallel side walls and defining an interior having a substantially uniform cross-section in the vertical direction;

means for introducing materials to be dried into said housing;

at least one drying stage having mesh means defining openings slightly greater than the largest size particle of the material to be dried, said drying stage located between the top and bottom walls and extending to the side walls of said housing;

air flow means for extracting air form the top of said housing and for creating a subatmospheric pressure and a rotating and upwardly vertical flow of air within said housing having a velocity within the mesh openings at least equal to the speed at which the material to be dried remains suspended, and for suspending the particles above the mesh means until enough particles accumulate above the mesh means to provide sufficient weight or downward pressure for the particles to overcome the upward air flow, pass through the openings in the mesh means and fall to the bottom of said housing.

2. The air dryer according to claim 1, wherein the air flow means comprise an air inlet means at the bottom of the housing and air outlet means at the top of the housing.

3. An air dryer according to claim 1, wherein the particle formed materials are seeds or grains.

4. An air dryer according to claim 1, wherein said housing is cylindrical.

5. An air dryer according to claim 1, wherein said means for introducing comprises a plurality of concentric distribution cones to distribute said materials over a horizontal plane of an uppermost drying stage.

6. An air dryer according to claim 1, further comprising supply means for supplying said materials to the interior of said distributor.

7. An air dryer according to claim 6, wherein said supply means is a belt conveyor.

8. An air dryer according to claim 1, wherein said mesh means comprises a ring and a wire mesh screen attached to said ring.

9. An air dryer according to claim 1, further comprising removal means for removing dried materials from the bottom of said housing.

10. An air dryer according to claim 1, wherein the number of said drying stages is about five.

11. An air dryer according to claim 1, wherein said air flow means comprises means for introducing air tangentially to the bottom of said housing.

12. An air dryer according to claim 1, further comprising heating means for heating the air entering the housing.

13. An air dryer according to claim 12, wherein said means for heating the air entering the housing comprises an inner chamber for receiving air to be heated and for providing heated air to the housing and an outer chamber, in thermal communication with the inner chamber, for receiving combustion air, whereby air in said inner chamber is heated through thermal contact with said outer chamber.

14. An air dryer according to claim which further comprises an extraction fan and a damper for controlling the upward rate of flow of air within said housing.

15. An air dryer according to claim 2, further comprising a separator placed after the outlet means for removing relatively small particle material from outlet air.

16. An air dryer according to claim 1, further comprising material removal means at the bottom of the housing for removing said dried materials.

17. An air dryer according to claim 1, wherein said housing has a plurality of windows for monitoring drying stages within said housing.

18. An air dryer according to claim 1, further comprising means for dividing the interior of said housing into a plurality of vertical chambers.

19. An air dryer according to claim 1, wherein said outlet means comprises an upper spiral shaped exit chamber communicating with the housing top by a plurality of openings in the vicinity of the top of said housing, and a corresponding plurality of pivotable gates over said openings to control the air flow through said openings, and the rotation of the upward airflow.

20. An air dryer according the claim 1, wherein said air flow means further comprises a lower spiral shaped air flow chamber communicating with the chamber bottom wall by a plurality of openings in the bottom wall of said housing, and a corresponding plurality of pivotable gates over said openings to control the air flow through said openings.

21. A method for drying particle formed materials comprising the steps of:

loading particle formed materials to be dried into the top of a housing of a dryer having a top, bottom and substantially parallel side walls to define an interior having a substantially uniform cross-section in the vertical direction, and at least one drying stage having a mesh means defining openings slightly greater than the largest size particles to be dried, said drying stage located between the top and bottom walls and extending to the side walls of the housing; and extracting air form the top of the housing and for creating a subatmosphere pressure and a rotating and upward air flow in said housing having a velocity within the mesh openings at least equal to the suspension speed of particles to be dried, whereby particles to be dried will remain suspended until enough particles accumulate above the mesh means to provide sufficient weight or downward pressure for the particles to overcome the upward air flow, pass through the opening sin the mesh means and fall to the bottom of said housing.

22. A method for drying materials according to claim 21, further including the step of heating said air prior to introduction of said air into said housing.

23. A method for drying materials according to claim 21, further including the step of introducing air into the top of said housing above the drying stage to inject dry air in the upper portion of the chamber.

24. A method for drying materials according to claim 21, further including the step of removing said dried materials from the bottom of said housing.

25. A method for drying materials according to claim 21, wherein the materials are seeds or grains.

26. A method for drying materials according to claim 21, further including the step of providing a plurality of drying stages vertically spaced from each other.

* * * * *